United States Patent [19]

Engström

[11] Patent Number: 4,732,113

[45] Date of Patent: Mar. 22, 1988

[54] PARTICLE SEPARATOR

[75] Inventor: Folke Engström, San Diego, Calif.

[73] Assignee: A. Ahlstrom Corporation, Karhula, Finland

[21] Appl. No.: 23,570

[22] Filed: Mar. 9, 1987

[51] Int. Cl.[4] ..... F22B 1/00

[52] U.S. Cl. ..... 122/4 D; 110/216; 110/245; 406/173

[58] Field of Search ..... 122/4 D, 20 B; 110/216, 110/245; 431/7, 170; 406/173; 55/337

[56] References Cited

U.S. PATENT DOCUMENTS 2,182,862 12/1939 Allardice .
3,470,678 10/1969 Clark et al. .
4,640,201 2/1987 Holmes et al. ..... 122/4 D

FOREIGN PATENT DOCUMENTS 110504 5/1944 Sweden .
571222 8/1945 United Kingdom .

*Primary Examiner*—Edward G. Favors
*Attorney, Agent, or Firm*—Nixon & Vanderhye

[57] ABSTRACT

A separator for separating solid particles from a hot gas stream comprises a cyclone chamber having an axial gas outlet conduit. The outlet conduit is formed by a plurality of cooling tubes defining between the tubes a plurality of passages for the gas. The outlet conduit is connected to an opening in one or both ends of the cyclone chamber. Solids are separated by centrifugal forces as the gas flows in a curved path in the cyclone chamber and by inertia forces as the gas changes direction to flow into the outlet conduit.

21 Claims, 5 Drawing Figures

PARTICLE SEPARATOR

BACKGROUND AND SUMMARY OF THE INVENTION

The present invention relates to a particle separator of the cyclone type for removing particulate solids entrained in a gas stream and particularly relates to a particle separator of the cyclone type intended for separation of solids entrained in flue gases discharged from a circulating fluidized bed reactor.

Many different types of separators, including cyclone separators, have been constructed and used in the past. For example, in Swedish Pat. No. 110,504, there is disclosed a particle separator having a central gas outlet conduit which at one end is in open communication with a cyclone chamber. The outlet conduit is formed at least in part from a plurality of tubes in which a coolant flows. Only a small part of these cooling tubes are in contact with the circulating gases and hence cooling is inefficient.

In British Pat. No. 571,222, there is disclosed a centrifugal dust separator having a casing and an inlet in which dust-laden air is provided to a generally cylindrical chamber having an axially directed outlet. Surrounding the outlet is a plurality of ring deflectors which cause abrupt changes in the direction of the flow of gas entering the outlet. Here, the separator relies on a reduction in pressure to cause the separation of the gas and dust, the deflectors assisting in that regard.

In U.S. Pat. No. 3,470,678, there is disclosed a cyclone separator for use in high temperature operations. In that separator, a plurality of concentric metal tubes are separated one from the other by an annular space in which liquid coolant, in this case steam, is provided. Here, there is no concern evidenced for the temperature condition of the solids extracted from the stream of gas.

It will be appreciated that when adopting a separator of the cyclone type for use with a fluidized bed reactor, efficiency demands recovery of the heat. Concurrently, it is highly desirable that the solid particles removed from the gas return to the reactor at as high a temperature as possible.

According to the present invention, there is provided a particle separator of the cyclone type for removing solids entrained in a hot gas stream, including a cyclone chamber having an axis, together with means for guiding the stream of hot gases with entrained solids about the axis. An inlet duct is provided in communication with the cyclone chamber for introducing the stream into the cyclone chamber in a tangential direction. An outlet is provided adjacent the outer periphery of the cyclone chamber for removing solids separated from the stream.

A particular feature of the present invention resides in the construction of a conduit disposed in the cyclone chamber which extends generally in an axial direction and has a gas outlet. The conduit is formed from a plurality of tubes which extend generally in an axial direction with the tubes adapted to receive a cooling fluid. The tubes further define a plurality of slots therebetween providing for passage of the gas from the cyclone chamber into the conduit and through the gas outlet. Preferably, the tubes and the slots therebetween are arranged to abruptly change the direction of the flow of the gas flowing from the cyclone chamber through the slots into the conduit whereby in addition to centrifugal separation, solids and gases are separated by the inertia of the solids which substantially prevents entry of the solids into the slots and gas outlet conduit. Because the conduit is located generally centrally of the cyclone chamber and, because of the change in flow direction, the solids are efficiently separated from the hot gas stream and the hot separated gases lie in efficient heat exchange relation with the cooling fluid in the tubes.

In one form of the present invention, the tubes have a circular configuration with deflectors projecting generally tangentially of the tubes in the general circumferential direction of the flow of the gases about the cyclone chamber. Slots are formed between the distal ends of the deflectors and adjacent tubes, enabling the gas flow to substantially reverse its direction for flow inwardly toward the central portion of the conduit. In another form, the tubes are formed in a drop shape, with the apex of each drop-shaped tube extending generally tangentially toward the direction of the flow. Thus, the hot gas flows along the outside surface of the drop-shaped tube and then generally reverses its direction for flow along the opposite side of the drop-shaped tube and between it and the adjacent tube. The latter flow is generally radially inwardly into the conduit. In another form, baffles may be provided between a plurality of tubes whereby a plurality of slots are formed, as in contrast to continuous slots. Thus, the gas is efficiently cooled and the heat is recovered in the cooling fluid circulating through the tubes.

The particle separator hereof is particularly useful in conjunction with, and as part of a unitary construction with a fluidized bed reactor, i.e., a steam boiler. Thus, the uptake from the boiler is defined by opposed walls, one of which inclines adjacent the upper end of the uptake toward the opposite wall to define a gas inlet to the cyclone separator located adjacent the upper end of the uptake. Consequently, the gases are injected in a tangential direction into the cyclone separator for flow about an axis, generally coincident with the axis of the tubes forming the gas outlet conduit. The particles separated from the hot gas stream by centrifugal force lie adjacent an outer wall for flow downwardly between the outer wall and the one wall for return to the combustion chamber. Because of the spacing of the outer wall and the location of the cooling tubes generally coincident with the axis of the cyclone chamber, the particulate solids remain hot for return to the reactor.

Separators used in conjunction with fluidized bed reactors are also the subject of my prior U.S. patent applications Ser. Nos. 916,485 and 926,719, filed Sept. 22, 1986 and Nov. 4, 1986, respectively.

Accordingly, it is a primary object of the present invention to provide a novel and improved particle/gas separator having high separating efficiency, a capacity for efficiently cooling the gas and recovering heat therefrom without substantially cooling the separated particles and methods of operating the separator.

It is another object of the present invention to provide novel and improved apparatus and methods for separating particles from hot flue gases from a circulating fluidized bed reactor.

These and other objects and advantages of the present invention will become more apparent upon reference to the following specification, appended claims and drawings.

BRIEF DESCRIPTION OF THE DRAWING FIGURES

DETAILED DESCRIPTION OF THE DRAWING FIGURES

Figure 1:
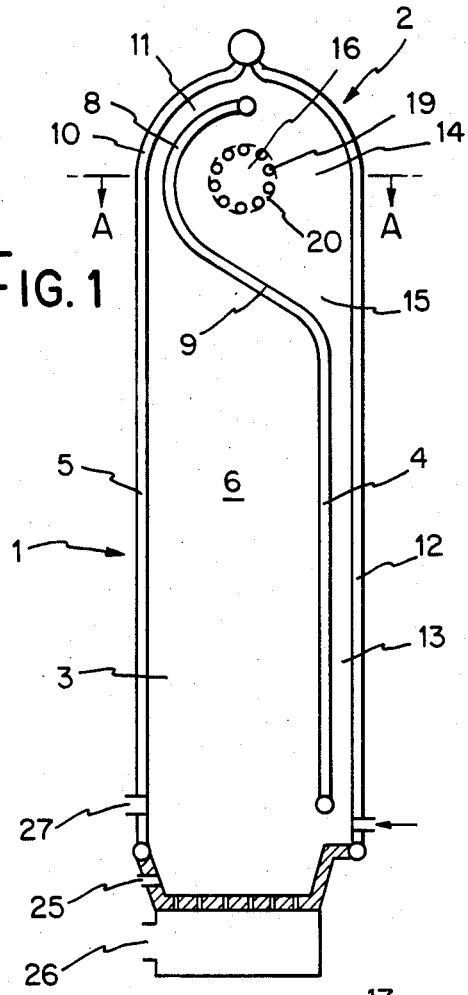
FIG. 1 is a vertical cross-sectional view of a combined cyclone separator and fluidized bed reactor constructed in accordance with the present invention.

In the illustrated preferred embodiment of the present invention, there is provided an upright fluidized bed reactor, i.e., a steam boiler, generally designated 1, and having a horizontally disposed cyclone separator, generally indicated 2, integrated therewith. Cyclone separator 2 is illustrated in FIG. 1 adjacent the upper end of the boiler uptake. The boiler may comprise a combustion chamber 3 defined by walls 4, 5, 6 and 7, each of which is preferably formed of tubes welded one to the other to form a gas-tight enclosure. The tubular walls 4 through 7 constitute heat transfer surfaces for the boiler and are connected at their upper ends to a water or stream circulation system, not shown.

The horizontally disposed cyclone separator 2 located adjacent the upper end of the uptake is in part formed by the upper end 8 of the tubular wall structure 4. That is, the tubular wall structure 4 extends upwardly from combustion chamber 3 and, adjacent the upper end of chamber 3, extends inwardly toward the opposite wall structure 5 to form a deflector or ceiling surface 9. Surface 9 directs flue gases into the channel between the curved upper end wall 8 and the curved upper end portion 10 of wall 5. Thus, the curved wall portions 8 and 10 form an inlet duct 11 for the cyclone separator 2. Below the ceiling surface or deflector 9, wall 4 forms, with an exterior or back wall 12, a duct 13, the lower end of which is connected to a lower part of the combustion chamber 3. From a review of the drawing, it will be appreciated that the upper end of back wall 12 connects with the upper end of front wall 5 in a distribution manifold which forms part of the water/steam distribution system, not shown.

With the foregoing described construction, the cyclone chamber 2 is formed by the inside surface of the upper end 8 of wall 4 and the inside surface of back wall 12. Thus, cyclone chamber 2 has a tangential inlet 11 for receiving the hot flue gases with the solids entrained therein and a tangential outlet 15 for receiving the particles separated from the hot gas stream. It will be appreciated that the inlet and outlet ducts may be separated or divided into two or more parallel ducts, as desired, and that to prevent erosion of the tubes of the boiler, the upper ends of the tube walls may be covered by a refractory material.

Figure 2:
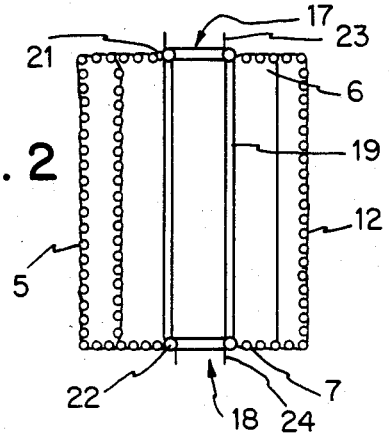
FIG. 2 is a horizontal cross-sectional view thereof taken generally about on line A—A of FIG. 1.

Within cyclone separator 2 and its chamber 14, there is provided a gas outlet conduit or pipe 16 which is generally coaxial with the horizontal axis of the separator. The outlet pipe 16 has end openings 17 and 18 (FIG. 2) through walls 6 and 7, respectively. It is a significant feature of the present invention that outlet conduit 16 is formed of a plurality of tubes 19 extending generally parallel one to the other and generally in an axial direction. The tubes 19 are spaced one from the other to define a plurality of axially extending slots 20 (FIG. 3) through which gas may pass from cyclone chamber 14 into outlet 16. The opposite ends of tubes 20 are connected to annular collector tubes 21 and 22 (FIG. 2) which, in turn, are connected to the water/steam distribution system of the boiler. Suitable connections, not shown, are provided between ducts 23 and 24 and the ends of the gas outlet conduit 16 for conveying the gas to the convection part of the boiler.

In operation, fuel is supplied to the combustion chamber through an inlet 25 in the lower part of the boiler. Fluidizing gas and combustion gas are also supplied through inlets 26 and 27, respectively. The flue gases, which contain entrained solids, are discharged from the upper end of combustion chamber 6 into the inlet passage 11 of the cyclone separator 2. As illustrated, such flue gases enter the cyclone chamber 14 tangentially, whereupon the gases and solids are separated by centrifugal action. Thus, the solids removed from the hot gas stream are collected adjacent the upper portion of wall 12 and flow downwardly through the solids outlet 15 between the walls 4 and 12 for return to the lower part of the combustion chamber. The gases, on the other hand, flow into the conduit 16 through the slots 20.

Figure 3:
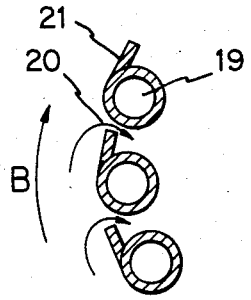
FIGS. 3, 4 and 5 are enlarged fragmentary cross-sectional views of various embodiments of cooling tubes used in the cyclone separator.

As illustrated in FIG. 3, tubes 19 have deflector fins 21 which extend tangentially of tubes 19 and in the direction of flow indicated B. Thus, the gases which flow about cyclone separator 2 in the circumferential direction designated B are deflected by fins 21. Such deflection causes the gases to abruptly change the direction of their flow from a generally circumferential direction to a generally reversed direction, i.e., a direction extending generally radially inwardly into conduit 16. When the gas flows into conduit 16, its direction changes to an axial direction. It will be appreciated that the gas flowing about conduit 16 contains some solids and that the change of direction of gas flow past tubes 19 causes these solids, because of their inertia, to maintain their direction of movement generally tangentially of conduit 16, thus becoming separated from the hot gas stream.

Figure 4:
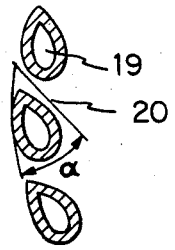

Referring now to FIG. 4, there is illustrated a further form of outlet conduit 16. In this form, the tubes 19 are drop-shaped and define passages 20 between the tubes, the direction of which defines an acute angle $\alpha$. Similarly, as the deflectors 21 of the previous embodiment illustrated in FIG. 3 extended generally tangentially of the direction of the flow B, the apices of the drop-shaped tubes likewise extend generally tangentially of the flow B and in the same direction as the flow. It will be appreciated that other shapes and cross-sectional configurations may be used for the tubes in the gas outlet conduit 16.

Figure 5:
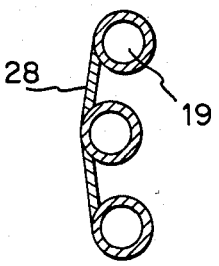

In FIG. 5, there is illustrated a still further form of the present invention wherein the tubes are spaced one from the other as in the previous embodiments but have plates or baffles 28 extending therebetween at axially spaced locations therealong. Thus, the slots or passages between the cooling tubes 19 can be located as desired along the axis and the periphery of the gas outlet conduit 16. By locating the plates or baffles 28 between the tubes, for example by welding, the distribution of the gas flowing to the outlet pipe can be influenced, for example in such a way that one end of the pipe is closed whereby all gas flows through the opposite end.

Consequently, it will be appreciated that the objects of the present invention have been accomplished in that the hot gases separated from the solids entrained in the hot flue gas stream are efficiently cooled, with maximum heat recovery, while simultaneously the solids separated from the stream retain substantially all of their heat for return to the combustion chamber.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A paritcle separator for separating solids and gases in a hot gas stream having solids entrained therein comprising:

a cyclone chamber having an axis and means for guiding the hot gas stream with entrained solids about an axis;

an inlet duct in communcation with said cyclone chamber for introducing the stream into said cyclone chamber;

at least one outlet for said cyclone chamber for removing solids separated from the stream in the cyclone chamber; and a conduit disposed in said cyclone chamber extending generally in an axial direction and having a gas outlet, said conduit being formed by a plurality of tubes extending generally in said axial direction with said tubes adapted to receive a coolant, said tubes defining a plurality of slots therebetween providing for passage of the gas from the cyclone chamber into said conduit and through said gas outlet.

2. A particle separator according to claim 2 wherein said tubes are arranged to change the direction of flow of the gas flowing from said cyclone chamber through said slots into said conduit.

3. A particle separator according to claim 2 including deflectors carried by said tubes for substantially reversing the direction of said gas flow from the cyclone chamber through said slots into said conduit.

4. A particle separator according to claim 3 wherein said deflectors comprise fins carried by said tubes.

5. A particle separator according to claim 2 wherein said tubes are generally circular in cross-section.

6. A particle separator according to claim 2 wherein said tubes are generally drop-shaped in cross-section.

7. A particle separator according to claim 1 wherein said tubes define an enclosure extending generally in said axial direction and having a predetermined cross-section.

8. A particle separator according to claim 1 wherein said tubes define a substantially circular array thereof extending generally in said axial direction.

9. A particle separator according to claim 7 including deflectors carried by said tubes for substantially reversing the direction of gas flow from the cyclone chamber through the slots into said conduit, said deflectors extending from said tubes in a tangential direction relative to the direction of the flow of said stream about said axis and extending from the tubes generally in the same direction as said flow.

10. A particle separator according to claim 7 wherein said tubes are generally drop-shaped in cross-section with the apices of the drop-shaped tube extending generally tangential to and in the same general direction as the direction of the flow of said stream about said axis whereby one side surface of the drop-shaped tube contacts the flow stream and the other side surface contacts the gases within the conduit.

11. A particle separator according to claim 1 in combination with a fluidized bed reactor.

12. A particle separator according to claim 11 wherein said reactor has an uptake defined by opposed walls with said cyclone chamber lying adjacent the upper end of said uptake, one of said walls adjacent the upper end of said uptake extending toward the opposite wall to define said inlet duct.

13. A particle separator according to claim 12 wherein said reactor includes an outer wall adjacent said one wall, the lower portion of said one wall defining with said outer wall said solids outlet.

14. A particle separator for separating solids and gas in a hot gas stream having solids entrained therein comprising:

a cyclone chamber having an axis and means for guiding the stream of hot gases with entrained solids about an axis;

an inlet duct in communication with said cyclone chamber for introducing the stream into said cyclone chamber;

at least one outlet from said cyclone chamber for removing the solids separated from the stream in the cyclone chamber; and means defining a conduit disposed in said cyclone chamber and having a gas outlet, said conduit means having a plurality of passages adapted to receive a coolant, said conduit means having a plurality of openings providing for passage of the gas from the cyclone chamber into said conduit in heat exchange relation with said plural passages whereby cooled gases flow through said gas outlet.

15. A particle separator according to claim 14 wherein said openings in said conduit means are located to provide a change in direction of the gas flow in said cyclone chamber from a generally circumferential direction to a generally radially inward direction into said conduit.

16. A particle separator according to claim 14 in combination with a fluidized bed reactor, wherein said reactor has an uptake defined by opposed walls with said cyclone chamber lying adjacent the upper end of said uptake, one of said walls adjacent the upper end of said uptake extending toward the opposite wall to define said inlet duct.

17. A particle separator according to claim 16 wherein said reactor includes an outer wall adjacent said one wall, the lower portion of said one wall defining with said outer wall said solids outlet.

18. A method for separating solids and gases in a stream of hot gases and solids entrained in said hot gases comprising the steps of:

guiding the stream in a cyclone chamber for flow about an axis to separate the solids and the gases in the stream; and diverting the flow of gases through a plurality of slots formed by tubes constituting a conduit extending generally in said axial direction;

flowing a coolant through said tubes.

19. A method according to claim 18 including diverting the flow of the stream from a generally circumferential direction about said axis to a flow directed inwardly generally toward said axis.

20. A method according to claim 18 in combination with a boiler having an uptake with the cyclone separator disposed adjacent the upper end of the uptake and including the steps of flowing the stream of hot gases with entrained solids upwardly from said boiler along said uptake, guiding the stream to one side of the uptake for entry into the cyclone chamber along a generally tangential path and guiding the solids removed from the stream downwardly to the boiler along the opposite side of the uptake.

21. A method according to claim 18 including forming said tubes to a predetermined cross-sectional shape to increase their contact surface area in heat exchange relation between the hot gases and coolant.

* * * * *